United States Patent [19]

Kato et al.

[11] Patent Number: 4,971,461

[45] Date of Patent: Nov. 20, 1990

[54] PRINTING DEVICE FOR EXCHANGING PRINTING ELEMENTS BY USE OF CHARACTER AND IDENTIFICATION CODE DATA

[75] Inventors: Kumiko Kato, Nagoya; Noriaki Kabeya, Ama, both of Japan

[73] Assignee: Brother Kogyo Kabushiki Kaisha, Nagoya, Japan

[21] Appl. No.: 499,802

[22] Filed: Mar. 27, 1990

[30] Foreign Application Priority Data

Mar. 31, 1989 [JP] Japan ..... 1-80799

[51] Int. Cl.[5] ..... B41J 3/42

[52] U.S. Cl. ..... 400/70; 364/519; 364/710.13; 400/144.2

[58] Field of Search ..... 400/70, 61, 62, 83, 400/144.2; 364/519, 710.13; 365/78, 189.01, 220, 221, 230.01

[56] References Cited

U.S. PATENT DOCUMENTS 4,755,070 7/1988 Cerutti ..... 400/144.2
4,768,164 8/1988 Dreher ..... 364/519
4,826,332 5/1989 Ukai et al. ..... 400/70
4,837,712 6/1989 Shibamiya ..... 364/519
4,866,671 9/1989 Yokoyama ..... 364/519
4,898,483 2/1990 Hzuka ..... 400/61

*Primary Examiner*—Eugene H. Eickholt
*Attorney, Agent, or Firm*—Kane, Dalsimer, Sullivan, Kurucz, Levy, Eisele and Richard

[57] ABSTRACT

In a printing device capable of exchanging a plurality of printing elements which correspond to a plurality of character sets, respectively, at least two of the character sets having common character data, the device sequentially receives text data including character data, and identification code data for identifying one of the character sets, the identification code data being put prior to the succeeding character data for indicating the character set used in preparing the succeeding character data differs from that used for the preceding character data, it is discriminated one by one whether the succeeding character data received by the data receiving means is one of the common character data in the character set used in preparing the preceding character data, and the device is controlled such that the identification code data is not stored in a print buffer until the succeeding character data is discriminated not to be one of the common character data.

17 Claims, 9 Drawing Sheets

FIG. 4(A)

KEY PATTERN KBI

SHIFT OFF 1 2 3 4 5 6 7 8 9 0 - =
q w e r t y u i o p ½ ]
a s d f g h j k l ; ' ±
z x c v b n m , . /
< π > § ² ³

SHIFT ON

! @ # $ % ¢ & * ( ) _ +
Q W E R T Y U I O P ¼ [
A S D F G H J K L : " •
Z X C V B N M , . ?
< ¶ > § ² ³

FIG. 4(B)

KEY PATTERN KBII

SHIFT OFF 1 2 3 4 5 6 7 8 9 0 - =
q w e r t y u i o p ´ `
a s d f g h j k l ñ ¡ ^
z x c v b n m , . ;
* # ß ¥ ç

SHIFT ON

! " / $ £ _ & ' ( ) % +
Q W E R T Y U I O P ¨ |
A S D F G H J K L Ñ ¿ =
Z X C V B N M ? . :
* # ß ¥ ç

FIG. 4(C)

KEY PATTERN KBIII

SHIFT OFF 1 2 3 4 5 6 7 8 9 0 ⌊ ⌋
γ δ ε θ τ υ ξ ι ο ρ π }
α σ φ ^ λ η ∂ κ ω ¡ / \
ζ χ ψ ¨ β ν μ | _ ~
© ♀ ♂ ` ´ ®

SHIFT ON

± × ÷ · — ≠ ≤ ≥ ∫ √ ⌈ ⌉
Γ Δ ← Θ — Ι Ξ ∣ ∣ ⌊ Π {
∇ Ζ ∓ < Λ Π > ∮ Ω ⌈ ⌉ ∫
≡ ≡ Ψ ∝ ∞ ∿ ∂ | _ =
© ♀ ♂ ` ´ ®

FIG. 7(A)

| | | | | | |
|---|---|---|---|---|---|
| KBI | A | B | KBII | C | ----- |

74 TEXT MEMORY

FIG. 7(B)

| | | | | | |
|---|---|---|---|---|---|
| KBI | A | B | KBII | C | ----- |

76 PRINT BUFFER

FIG. 7(C)

| | | | | |
|---|---|---|---|---|
| KBI | A | B | C | ----- |

76 PRINT BUFFER

FIG. 7(D)

| | | | | | |
|---|---|---|---|---|---|
| KBI | A | B | KBII | Ñ | ---- |

76 PRINT BUFFER

FIG. 7(E)

| | | | | |
|---|---|---|---|---|
| KBIII | $\phi$ | KBI | D | ---- |

74 TEXT MEMORY

FIG. 7(F)

| | | | |
|---|---|---|---|
| KBIII | $\phi$ | KBI | D |

76 PRINT BUFFER

PRINTING DEVICE FOR EXCHANGING PRINTING ELEMENTS BY USE OF CHARACTER AND IDENTIFICATION CODE DATA

BACKGROUND OF THE INVENTION

This invention relates to a printing device capable of exchanging its printing elements such as daisy wheels when printing is executed.

Generally, in word processing device such as electronic typewriters and word processors, a plurality of character sets (key patterns) are alternately used to define a single keyboard to input as many characters as possible through limited number of keys. Inputted character data are sequentially stored in a text memory, which is generally used as an input data storing means, with an identification code data of the used character set (key pattern) which is stored precedingly to the corresponding character data.

FIG. 7(A) shows an example of the input data stored in a text memory 74. In this example, three key patterns KBI, KBII and KBIII are used. Character data A and B are entered through the key pattern KBI, another character data C through the key pattern KBII, and character data $\phi$ through the key pattern KBIII.

The wheel-element type printing device used for aforementioned kind of word processing device comprises a plurality of daisy wheels corresponding to a plurality of key patterns, and one of the daisy wheels are installed corresponding to the used key pattern when printing is executed.

For example, when a file data in the text memory shown in FIG. 7(A) is printed, the data is sequentially read out of the text memory, the daisy wheel for key pattern KBI is rotated and the characters corresponding to the data are printed, respectively. In the event that an identification code of key pattern KBII is read out of the text memory, printing is interrupted for exchanging the daisy wheels, while a message indicating the exchange of the daisy wheels is displayed. The daisy wheel corresponding to key pattern KBII having been installed and print start key having been depressed, the printing execution is restarted.

As described above, in the conventional printing device, printing is interrupted and message indicating wheel exchange is displayed every time when the identification code for key pattern KBI, KBII, or KBIII, etc. is read out of the text memory. Practically, however, there are a lot of cases where printing can be kept executing without exchanging the daisy wheels; exchange of the daisy wheels makes the printing execution troublesome and takes more time than actually needed. That is, there are lots of characters simultaneously existing in a plurality of key patterns. It is assumed that, for example, alphabetic letters exist both in key patterns KBI and KBII. In this case, when the data shown in FIG. 7(A) is printed, although the characters of A, B, and C can be printed with the daisy wheel corresponding to the key pattern KBI, printing is interrupted after characters A and B have been printed, and the exchange of the daisy wheels is required, which is practically unnecessary.

If an operator is inexperienced, and unnecessary switching between each key pattern is executed, the printing execution becomes troublesome and requires more time than necessary. For example, assume that the operator first inputs characters using the key pattern KBI, switches to KBII to input other characters, switches back to KBI, then switches again to KBII. In this case, the characters inputted by using the key pattern KBI after inputted by using the key pattern KBII may exist in the key pattern KBII. If so, it is unnecessary to switch from the key pattern KBI to the key pattern KBII and back to the key pattern KBI. This switching operations are unnecessary and can be omitted.

On the other hand, there exist the case that characters inputted by using one key pattern are inserted among the characters inputted by using another key pattern when text is edited. For instance, assume that among the sequence of characters inputted by using the key pattern KBII, another sequence of characters inputted by using the key pattern KBI is inserted. In this case, if the inserted characters exist also in the key pattern KBII, the identification code of the key pattern KBI to be stored in the text memory is actually unnecessary. In other words, unnecessary exchanging of the daisy wheels is required in such a occasion.

This kind of exchange makes the printing execution troublesome and it may unnecessarily take much time to execute printing.

SUMMARY OF THE INVENTION

It is therefore an object of the invention to provide an improved printing device capable of printing text data avoiding an unnecessary interruption of printing execution for exchanging the daisy wheels when text data is printed.

In order to accomplish above object, according to the present invention, there is provided a printing device capable of exchanging a plurality of printing elements which correspond to a plurality of character sets, respectively, at least two of said character sets having common character data, said device comprising:

data receiving means for sequentially receiving text data to be printed;

said text data including character data, and identification code data for identifying one of said character sets, said identification code data being put prior to the succeeding character data for indicating the character set used in preparing said succeeding character data differs from that used for the preceding character data; and printing data storing means for sequentially storing data received by said data receiving means;

said printing device further comprises:

discriminating means for discriminating one by one whether said succeeding character data received by said data receiving means is one of said common character data in the character set used in preparing said preceding character data; and controlling means for controlling said device such that said identification code data is not stored in said printing data storing means until the succeeding character data is discriminated not to be one of said common character data by said discriminating means.

DESCRIPTION OF THE ACCOMPANYING DRAWINGS

FIG. 4(A) shows character sets corresponding to key pattern KBI;

FIG. 4(B) shows character sets corresponding to key pattern KBII;

FIG. 4(C) shows character sets corresponding to key pattern KBIII;

FIG. 6, 6(A), 6(B) and 6(C) are flowcharts of a control routine;

FIGS. 7(A) through 7(F) show data in the text memory and print buffer.

DESCRIPTION OF THE EMBODIMENTS

Figure 1:
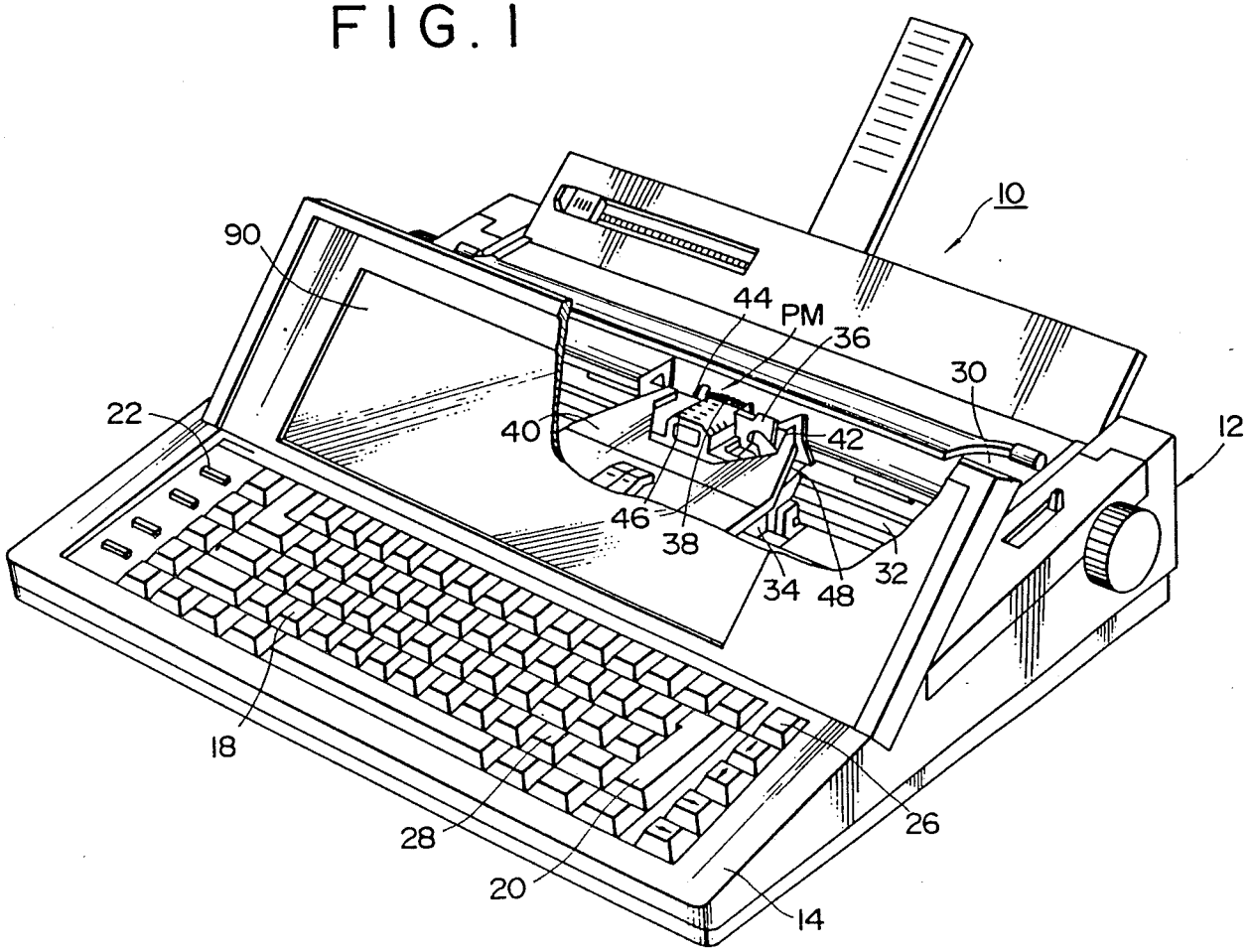
FIG. 1 is a perspective view of a electronic typewriter embodying the present invention.

As shown in FIG. 1, a keyboard 14 is disposed in the front portion of a body frame 12 of an electronic typewriter 10. A printing mechanism PM is disposed in the body frame 12 behind the keyboard 14 and a liquid crystal display 90 for displaying characters and symbols entered is also provided in the rear of the keyboard 14.

There are also arranged character keys 18 including alphabet and symbol keys, a return key 20, a KB (keyboard) conversion key 22, a print key 26, a shift key 28, and other function keys on the keyboard 14 as in an ordinary typewriter.

Then, one of three key patterns KBI, KBII, and KBIII is selectively used for inputting character data through the character keys 18 on the keyboard 14 by operating the KB conversion key 22.

Figure 2:
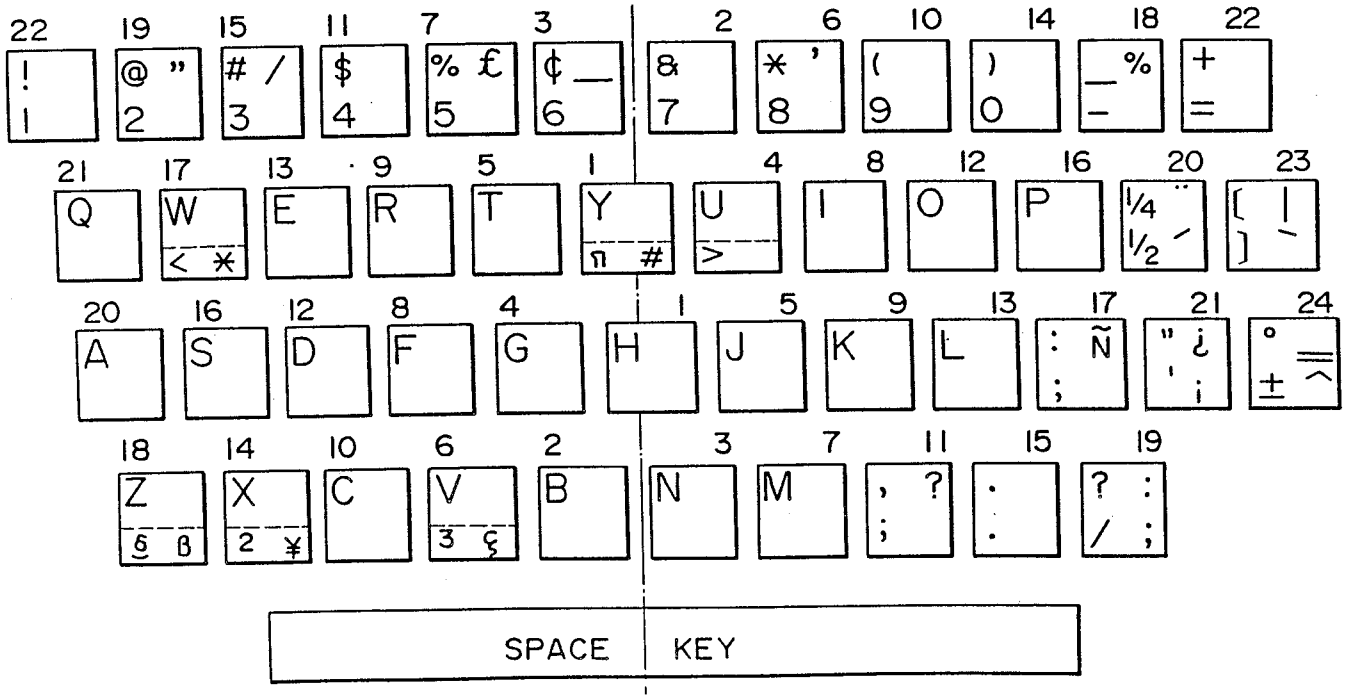
FIG. 2 illustrates key arrangements of key patterns KBI and KBII.

FIG. 2 illustrates key arrangements of the key patterns KBI and KBII.

Characters of the key pattern KBI are shown on the left hand side of each key, those of the key pattern KBII are on the right hand side of each key. Characters defined when the shift key 28 is ON are shown on upper side of each key, those defined when the shift key 28 is OFF are shown on lower side of each key.

Note that, when only one character is shown on one key, the character is a common character used both in two key patterns KBI and KBII.

Figure 3:
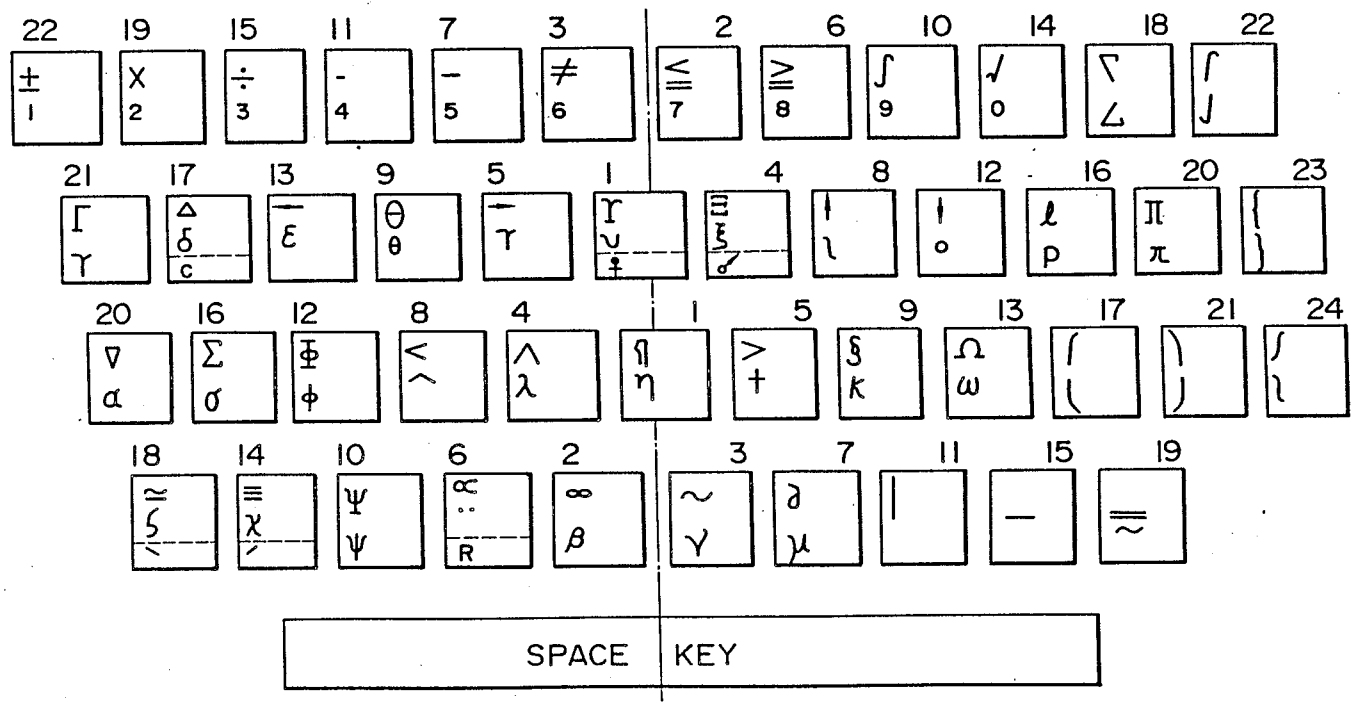
FIG. 3 illustrates key arrangements of key pattern KBIII.

FIG. 3 shows an key arrangements when the key pattern KBIII is selected. In this case, characters represented on upper and lower sides of each key are defined when the shift key 28 is ON and OFF, respectively. Accordingly, when the key pattern KBI is selected, the character keys 18 are defined by a character set shown in FIG. 4(A). When the key pattern KBII is selected, the character keys 18 are defined by a character set shown in FIG. 4(B), and when the key pattern KBIII, the character keys 18 are defined by a character set shown in FIG. 4(C).

The printing mechanism PM comprises a platen 30 for feeding printing paper, a motor (not shown) with a drive circuit for driving the platen 30, a carriage 34 supported by a guide 32 set in parallel to the platen 30, a motor (not shown) with a drive circuit for transversely reciprocally driving the carriage 34, a daisy wheel 38 accommodated in a wheel cassette 36, a motor with a drive circuit for driving the daisy wheel 38, a printing ribbon 42 accommodated in a ribbon cassette 40, a motor with a drive circuit for rolling the printing ribbon 42, a printing hammer for striking types 44 of the daisy wheel 38, a solenoid (not shown) with a drive circuit for driving the printing hammer, a ribbon switching mechanism (not shown) for selectively arranging the printing ribbon 38 or a correction ribbon 48 at the printing position, etc. The printing mechanism PM is similar to that of any other ordinary electronic typewriters.

There are three kinds of wheel cassettes for the key patterns KBI, KBII and KBIII in which daisy wheels 38 corresponding to character sets shown in FIGS. 4(A), 4(B) and 4(C), respectively.

Figure 5:
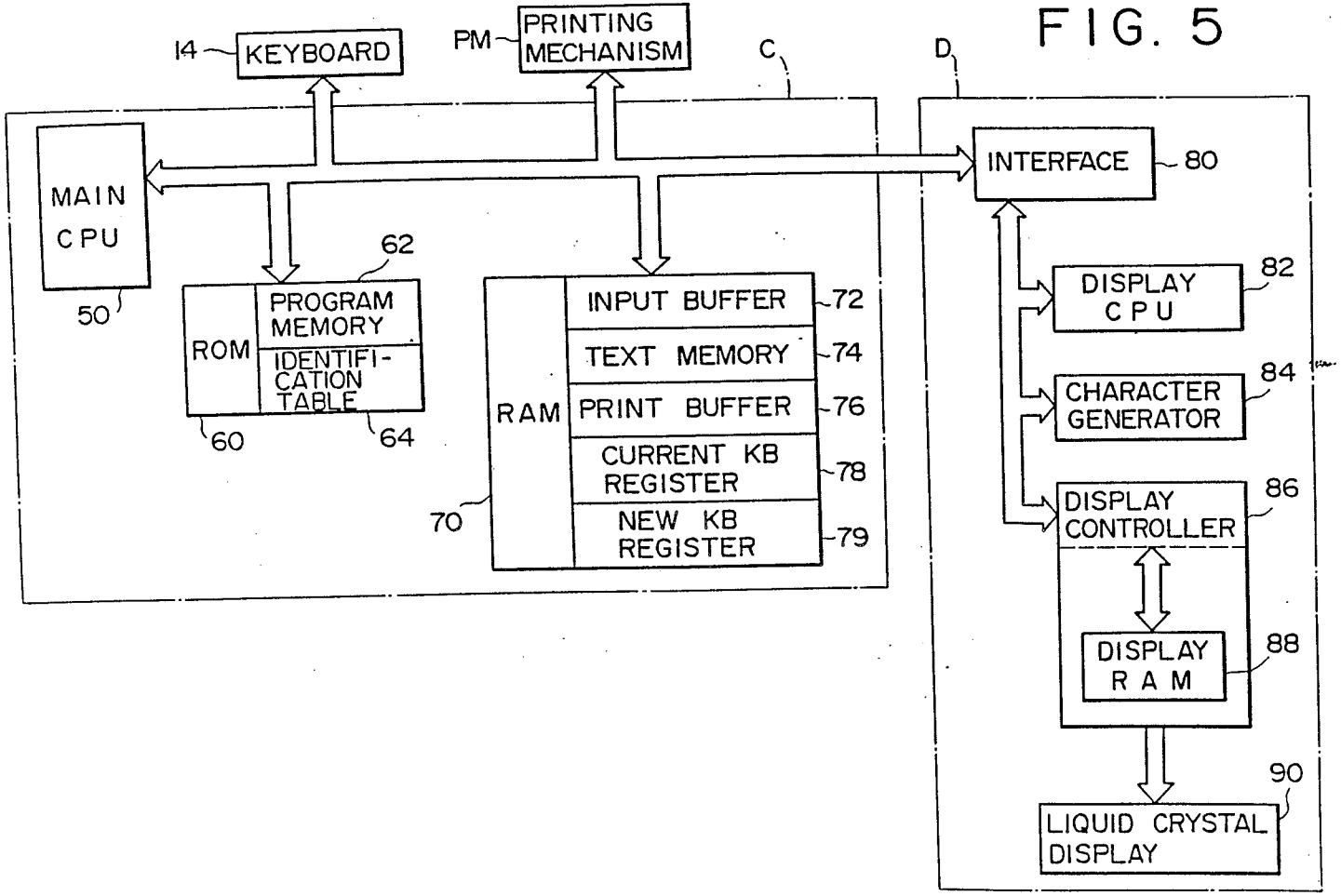
FIG. 5 is a block diagram illustrating a control system of the electronic typewriter.

FIG. 5 shows a block diagram of the control system of the electronic typewriter of this embodiment.

The electronic typewriter 10 basically comprises the keyboard 14, the printing mechanism PM, a display unit D, a control unit C, etc. The keyboard 14, the printing mechanism PM and the display unit D are connected via a data bus, etc. to a main CPU 50 of the control unit C.

The control unit C comprises the main CPU 50, a ROM 60 and a RAM 70 connected via a data bus, etc. to the main CPU 50.

ROM 60 comprises a program memory 62 and an identification table 64. The program memory 62 stores programs for controlling the printing mechanism PM and the display unit D in conformity with code data entered through the character keys 18 and the function keys of the keyboard 14. The identification table 64 stores data of the character sets corresponding to the key patterns KBI, KBII, and KBIII, which is used for examining whether a character data is a common data or not.

The RAM 70 comprises an input buffer 72, a print buffer 76, a current KB register 78, and a new KB register 79. The input buffer 72 stores data of the characters entered through the keys 18 of the keyboard 14 or those read out of the text memory 74. The print buffer 76 temporarily stores data sequentially read out of the text memory 74 corresponding to a character, a numeral, or a symbol one after another. When the data is stored in the print buffer 76, an identification code of the current KB pattern is stored in the current KB register 78. When the identification code for the new key pattern is read out of the text memory 74, the new identification code is stored in the new KB register 79.

The display unit D comprises an interface 80, a display CPU 82, a character generator 84, a display controller 86 and a display RAM 88, these being connected as shown in FIG. 5.

Approximately 400 kinds of dot matrix display data are stored in the character generator 84 correspondingly to character code data so that characters and symbols are displayed on the display 90.

Based on the command data and the character data supplied from the main CPU 50 via the interface 80, the display CPU 82 reads the corresponding display data from the character generator 84 and supplies the display data to the display controller 86. The display controller 86 writes the display data onto the display RAM 88 and simultaneously supplies a display signal corresponding to the display data to the display 90. Moreover, the display CPU 82 controls the movement of a cursor (not shown) in order to give the display controller 86 an instruction as to an address to which the cursor has moved via the interface 80 in conformity with the data on the movement of the cursor received from the main CPU 50.

The main CPU 50 makes the display 90 display each character/symbol entered through the keyboard 18 based on the control program, and after the text having been edited, the main CPU 50 makes the text memory 74 store the display data correspondingly to the display position thereof.

Figures 6, 6A:
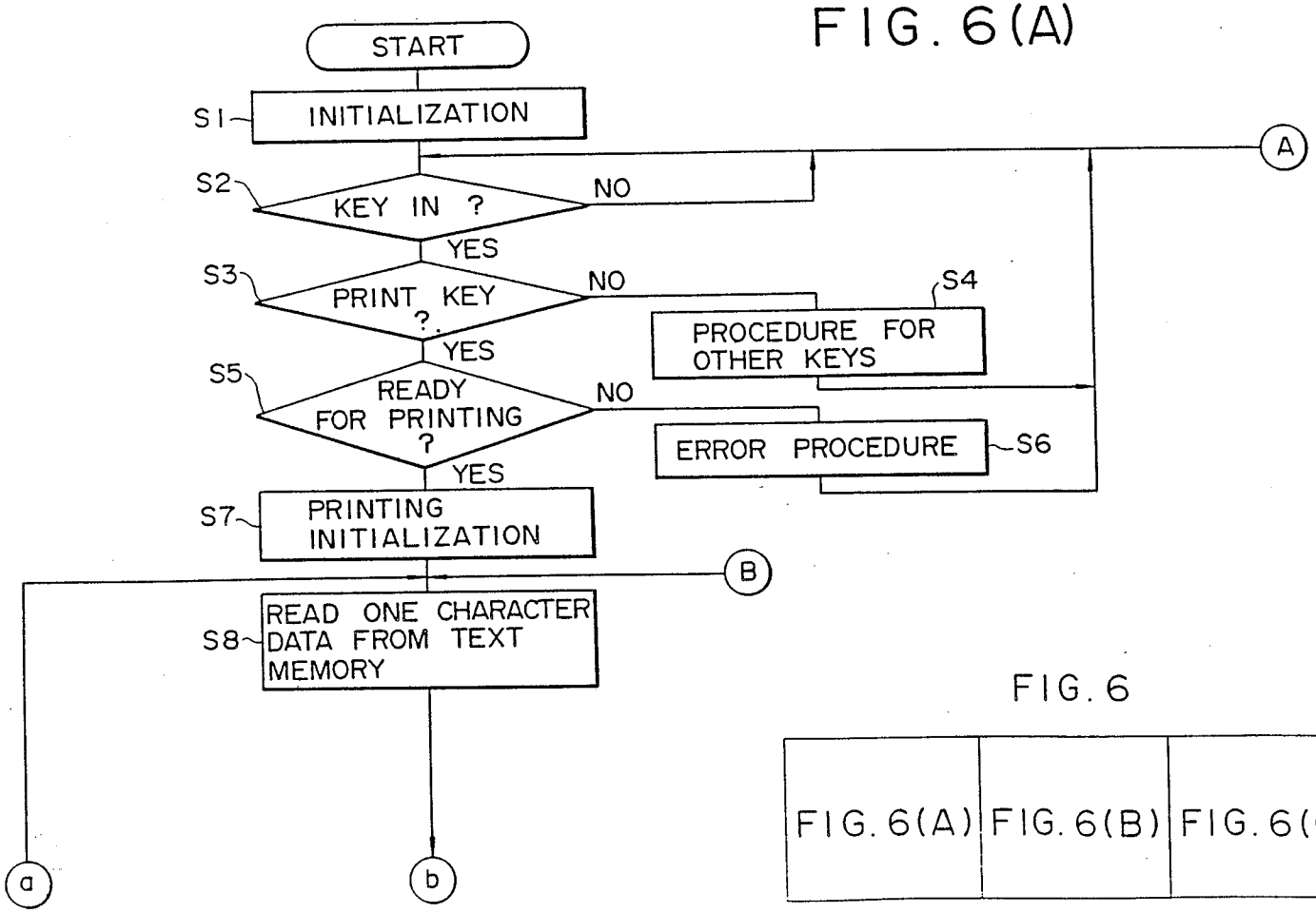
Figure 6B:
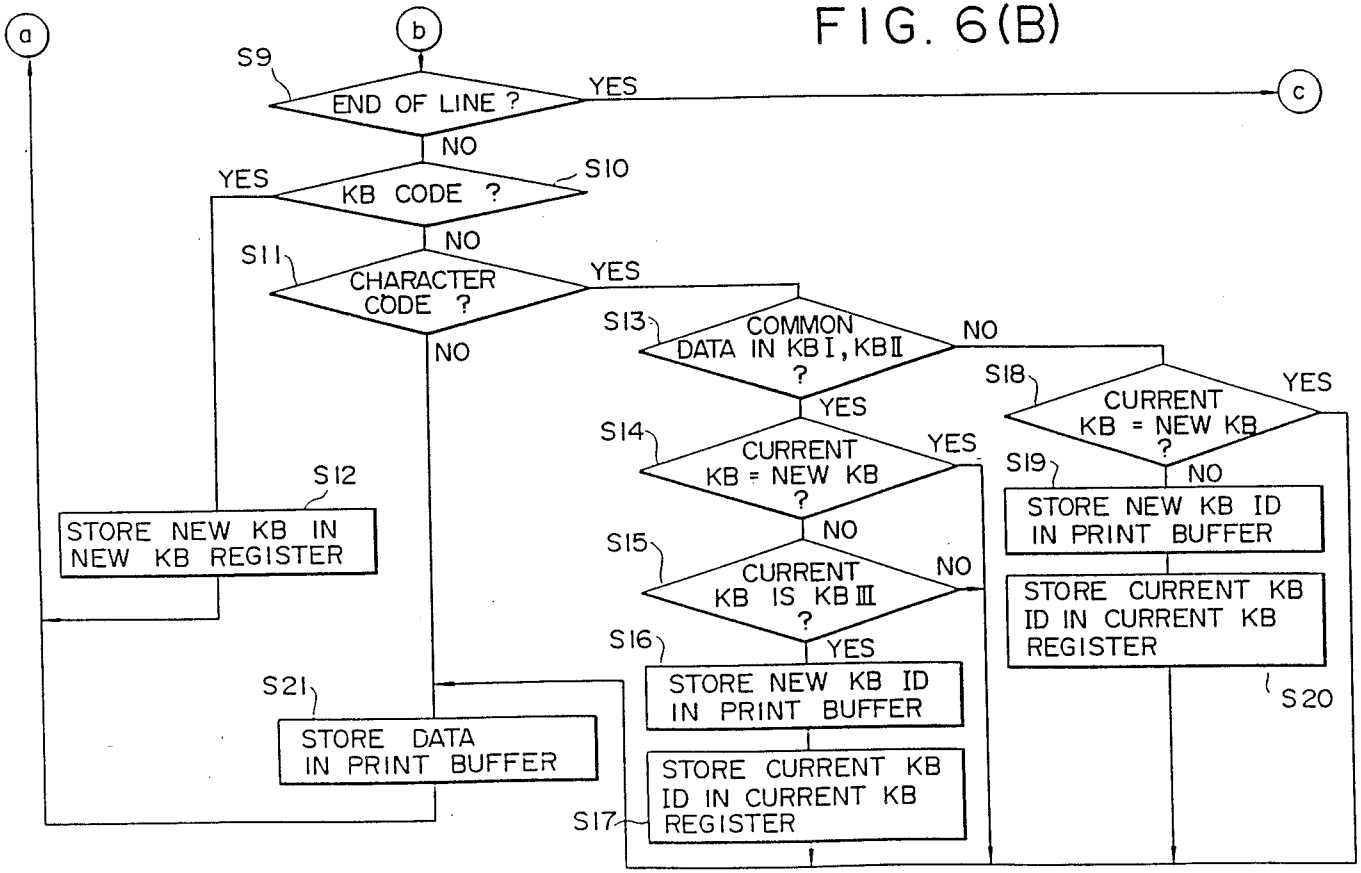
Figure 6C:
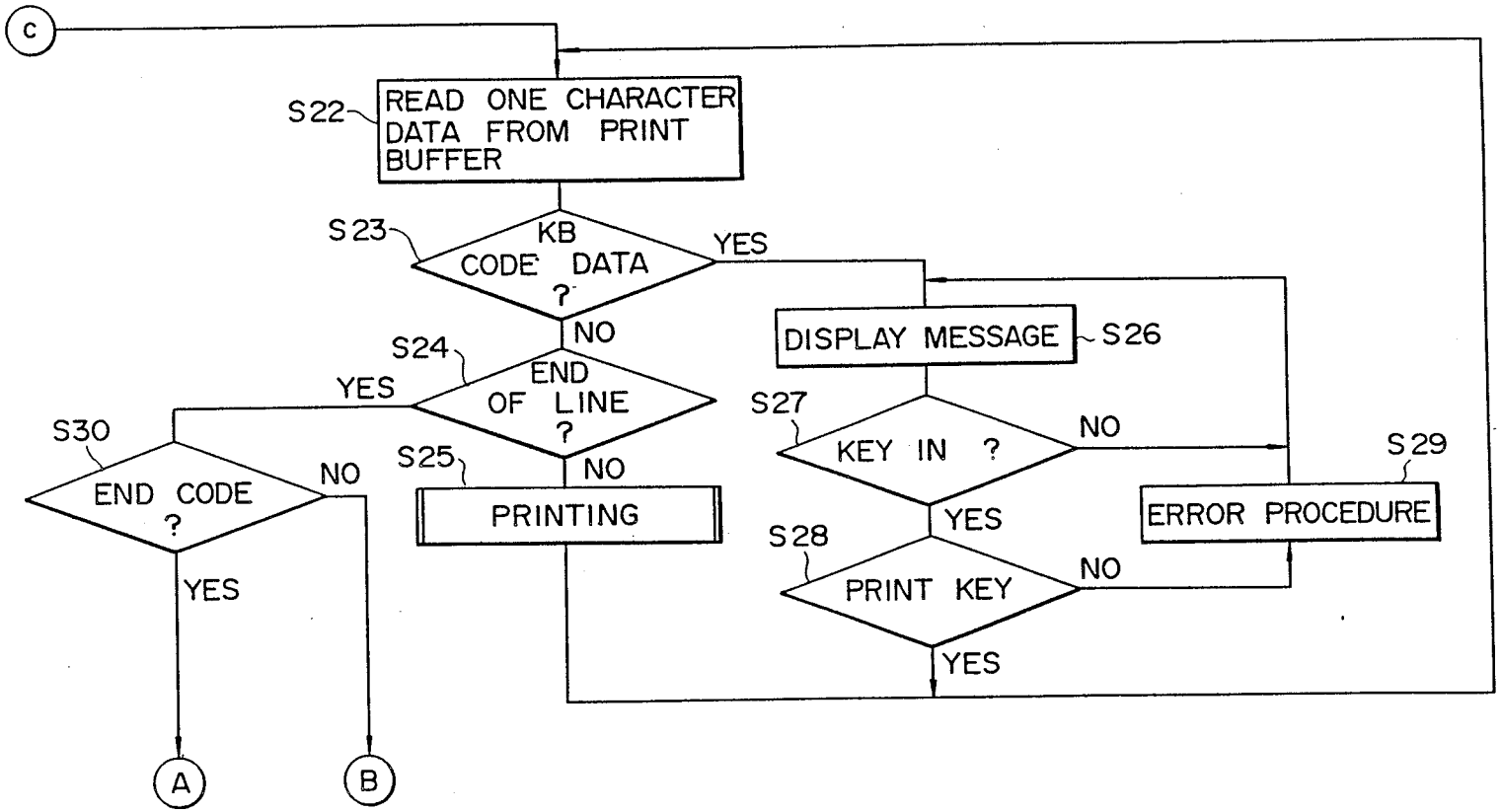

FIG. 6 is a flow chart illustrating a printing performance of the electronic typewriter.

When a power is supplied to the electronic typewriter 10, an initialization is done in step S1, then the procedure pauses to wait for key input in step S2. When the key is determined to be inputted in step S2, it is examined whether the key is a print key 26 or not in step S3. If determined NO, procedures according to the key operations is done, respectively, and the procedure returns to step S2 for inputting. If determined YES at step S3, it is further examined in step S5 whether file data to be printed is selected or not in steps S2 through S4. If it is determined NO in step S5, a buzzer is sounded to inform an error condition and the procedure returns to step S2. If it is determined YES at step S5, an initialization for printing is performed in step S7. In this initialization for printing in step S7, a file data selected among the data stored in the text memory 74 is indicated and a print mode starts. The key pattern firstly used in the file to be printed is recognized and the identification code for the recognized key pattern is stored in the KB register 78 and the print buffer 76.

For example, when a file shown in FIG. 7(A) is selected, the identification code for the key pattern KBI is stored in the KB register 78 and the print buffer 76, and the procedure goes to next step S8 to start printing. This printing execution includes the repetition of the following sequence:

data corresponding to one character of the text file to be printed is sequentially read out one after another; the data read out of the text file is written in the print buffer 76; if it is determined that the data of one line is read out of the text file and written in the print buffer 76, the procedure goes to step S22; a line of image is printed corresponding to the data stored in the print buffer 76.

That is, print initialization is done in step S7, then data corresponding to one character is read out in step S8, the read out data is examined whether it is an end-of-line code, i.e., end code, return code or the like, (in step S9), a key pattern identification code (in step S10), or a character code (in step S11). When the data is determined to be an end code, the procedure goes to step S22; when determined to be an identification code, the procedure goes to step S12; when determined to be a character code, the procedure goes to step S13.

Note that, when the read out data is an identification code of the key pattern KBI as shown in FIG. 7(A), the procedure goes to step S12, and the read out new identification code is stored in the new KB register 79, then the procedure goes to step S8.

When a character data "A" is read out of the text memory 74 in step S8, the procedure goes to step S11 through steps S9 and S10. As the data is determined to be a character code, the procedure goes to step S13.

The control device C detects common character data stored in common data identification table 64 to examine whether the read out character data "A" is a common data which simultaneously exists in the key patterns KBI and KBII. As shown in FIGS. 5(A) and 5(B), the character data "A" is a common data between the key patterns KBI and KBII, and therefore, the procedure goes to step S14 where it is further examined whether the identification codes stored in the current KB register 78 and the new KB register 79 are the same or not. In this example, since both codes stored in the current KB and the new KB registers are the same, the procedure goes to step S21 and the read out character data "A" is stored in the print buffer 76 as shown in FIG. 7(C). The procedure then returns to step S8.

When it is determined that the read out data is not exist in two of the key patterns KBI, KBII, and KBIII (NO at step S14), the procedure goes to step S18 and it is examined whether the identification codes stored in the current KB register 78 and the new KB register 79 are the same or not. In this case, it is determined YES at step S18, and the character data is stored in the print buffer 76 at step S21.

A character data "B" is read out of the text memory 74 at step S8 as well, and stored in the print buffer 76 at step S21. Next, an identification code "KBII" is read out of the text memory 74 at step S8. The procedure goes to step S12 by way of steps S9 and S10, where the read out identification code "KBII" is stored in the new KB register 79, then the procedure returns to step S7. Consequently, the codes stored in the current KB register 78 and the new KB register 79 have become different.

Subsequently, when a character data "C" is read out of the text memory 74, the procedure goes to step S13 through steps S9, S10, and S11, and it is examined that the data read out of the text memory 74 exists both in the key patterns KBI and KBII or not. In this case, as the character data "C" is a common data, the procedure goes to step S14. In step S14, it is examined whether the identification code stored in the current KB register 78 equals to that in the new KB register 79 or not. As it is determined to be NO, in this case, then it is further examined whether the identification code "KBIII" is stored in the current KB register 78 or not. As the identification code of KBI is stored in this case, the procedure goes to step S21. The character data "C" read out of the text memory 74 is stored in the print buffer 76 in step S21 and the procedure goes to step S8.

As described above, even if the identification code, e.g., "KBII", is newly read out from the text memory 74, the new identification code read out of the text memory 74 is not stored in the print buffer 76 as long as the character data to be succeedingly read out of the text memory 74 is commonly exists in the preceding key pattern KBI.

When the character data read out of the text memory 74, in which the character data is stored following to the identification code, is not commonly exists both in the key patterns KBI and KBII, e.g. "N" which exists only in key pattern KBII, it is determined to be NO in step S13. Then, it is determined to be NO in step S18 as the codes stored in the KB register 78 and the new KB register 79 are different, and the procedure goes to step S19. In step S19, the identification code of the key pattern KBII stored in the new KB register 79 is transmitted to the print buffer 76 as shown in FIG. 7(D), and in step S20, the identification code of the key pattern KBII is transmitted to the current KB register 78. Subsequently, the read out character data "N" is stored in the print buffer 76 in step S21, and then the procedure goes to step S8.

When a file data in the text memory 74 is as shown in FIG. 7(E), and when the character data "$\phi$" has been stored in the print buffer 76, the identification code of key pattern KBIII is stored both in the current KB register 78 and the new KB register 79.

In this case, the identification code for the key pattern KBI is read out of the text memory 74 in step S8. Then, the procedure goes to step S12 through steps S9 and S10, and the identification code for the key pattern KBI is stored in the new KB register 79. That is, the identification code stored in the new KB register 79 is changed from that for the key pattern KBIII to that for the key pattern KBI. After that, the procedure goes to step S8. Subsequently, the character data "D" is read out of the text memory 74, while the procedure goes to step S13 through steps S9, S10 and S11, and it is examined whether the read out character data "D" is a common data between the key patterns KBI and KBII. In this example, the character data "D" is, as shown in FIG. 4, a common data and it is further examined whether the identification code stored in the current KB register 78 equals to that in the new KB register 79 or not. Since the identification codes stored in the current KB register 78 and the new KB register 79 are those for the key patterns KBIII and KBI, it is determined to be NO in step S14 and the procedure goes to step S15. It is examined whether the identification code stored in the current KB register 78 is that for the key pattern KBIII or not in step S15. Fundamentally, when a data is a common data between key patterns KBI and KBII, the identification code newly read out of the text memory 74 is not stored in the print buffer 76, but when the identification code of the key pattern KBIII is stored in the current KB register 79, the newly read out identification code from the text memory 74 is stored in the print buffer 76. That is, after storing the identification code for the key pattern KBI in the print buffer 76 in step S16 and the identification code of the key pattern KBI is stored in the KB register 78 in step 17, the character data "D" is stored in the print buffer 76 in step S21, and then the procedure returns to step S8.

On repeating the procedure described above, for example, the text file shown in FIG. 7(A) is transferred into the print buffer 76 as shown in FIG. 7(C).

When the last code data of one line (soft-return code, return code or end code) is read out of the text memory 74 in step S8, the procedure goes to step S22 through step S9, and a line data transferred from the text memory 74 to the print buffer 76 is printed by the printing mechanism PM (in steps S23 through S25).

During printing is executed, at every time the identification code for the key pattern is read out of the print buffer 76, printing is interrupted (YES in step S23), and the instruction for exchanging the daisy wheels 38 corresponding to the read out identification code is displayed on the display 90 in step S26. After the daisy wheel 38 is changed to the instructed one and the print key 26 is depressed, it is determined to be YES in step S28 and printing is restarted.

Comparing printing performance of the electronic typewriter of the present embodiment with a conventional one, the text file shown in FIG. 7(A) is stored in the print buffer 76 as shown in FIG. 7(C) in the present typewriter, while the text file shown in FIG. 7(A) being stored as shown in FIG. 7(B) in the conventional one. Accordingly, the present one is capable of print the character "A", "B" and "C" continuously by using the daisy wheel 38 corresponding to the key pattern KBI, while the conventional one is not capable of printing the character "C" until the daisy wheel for the key pattern KBI is changed to that for the key pattern KBII after printing the characters "A" and "B". Accordingly, it becomes less frequent to exchange the daisy wheel with the electronic typewriter according to the present invention than with the conventional one.

When a line of data is printed on the recording sheet, i.e., return code or the like is detected, (YES in step S24), the procedure goes to step S30 and it is examined whether the end code is read out or not. If the code is determined not to be the end code, i.e., it is a return code (or soft-return code), the procedure returns to step S8 and the next line is printed as above. If the code is determined to be the end code in step S30, the procedure returns to step S2 to wait for key input.

It should be noted that the present invention is not limited to the embodiment described above but can be modified within the spirit and scope of the invention.

For example, although three key patterns are employed in the above embodiment, only two key patterns can be employed. Further, four or more key patterns can be employed.

Although the daisy wheels are utilized as printing elements in the above embodiment, the invention can be applied to typewriters employing other types of printing elements other than the daisy wheels.

As illustrated above, according to the present invention, when character data inputted through a keyboard defined by a plurality of character sets are printed, even though an identification code of different character set from the currently used one is read out of the text memory, it is checked whether exchanging of printing elements is necessary or not by comparing the read out character data with the character set corresponding to the currently utilized printing element. This characteristic feature of the present invention lessens the unnecessary interruption of printing and unnecessary exchange of the printing elements, which saves the period of time for printing the text data, and further, makes the operator less troublesome to operate the printing device.

What is claimed is:

1. A printing device capable of exchanging a plurality of printing elements which correspond to a plurality of character sets, respectively, at least two of said character sets having common character data, said device comprising:

data receiving means for sequentially receiving text data to be printed;

said text data including character data, and identification code data for identifying one of said character sets, said identification code data being put prior to the succeeding character data for indicating the character set used in preparing said succeeding character data differs from that used for the preceding character data; and printing data storing means for sequentially storing data received by said data receiving means;

said printing device further comprises:

discriminating means for discriminating one by one whether said succeeding character data received by said data receiving means is one of said common character data in the character set used in preparing said preceding character data; and controlling means for controlling said device such that said identification code data is not stored in said printing data storing means until the succeeding character data is discriminated not to be one of said common character data by said discriminating means.

2. The printing device according to claim 1, wherein said discriminating means comprises identification data storing means for storing data of said character sets to be identified by said identification code data, said discriminating means discriminate whether said first character set is different from said second character set with referring to the data stored in said identification data storing means.

3. The printing device according to claim 2, which further comprises first and second memory means for storing the identification code data of said first character set and said second character set, respectively, the identification code data being stored in said second memory means when the identification code corresponding to said second character set is received by said data receiving means.

4. The printing device according to claim 2, wherein the identification code data stored in said second memory means is transferred to said first memory means when the succeeding character data is discriminated not to be one of said common character data by said discriminating means.

5. The printing device according to claim 1, which further comprises print controlling means for controlling said device to print the data stored in said printing data storing means when data of one line is entered in said printing data storing means.

6. The printing device according to claim 1, which further comprises print controlling means for controlling said device to pause for changing of a currently used printing element to another printing element carrying the character set identified by the identification code data read out of said printing data storing means when said identification code data is read out of said printing data storing means.

7. The printing device according to claim 6, which further comprises representing means for representing the pausing condition when said identification code data is read out of said printing data storing means.

8. The printing device according to claim 1, wherein said printing elements comprises daisy wheels which carry said character sets, respectively.

9. A word processing apparatus capable of exchanging a plurality of printing elements for printing which correspond to a plurality of character sets, respectively, at least two of said character sets having common character data, said device comprising:

input means for inputting text data;

text data storing means for sequentially storing text data inputted through said input means to be printed;

said text data including character data, and identification code data for identifying one of said character sets, said identification code data being put prior to the succeeding character data for indicating the character set used in preparing said succeeding character data differs from that used for the preceding character data;

printing data storing means for sequentially storing data for printing; and read-out means for reading said text data stored in said text data storing means;

said word processing device further comprises:

discriminating means for discriminating one by one whether said succeeding character data read out of said text data storing means is one of said common character data in the character set used in preparing said preceding character data; and controlling means for controlling said device such that said identification code data is not stored in said printing data storing means until the succeeding character data is discriminated not to be one of said common character data by said discriminating means.

10. The printing device according to claim 9, wherein said discriminating means comprises identification data storing means for storing data of said character sets to be identified by said identification code data, said discriminating means discriminate whether said first character set is different from said second character set with referring to the data stored in said identification data storing means.

11. The word processing device according to claim 10, which further comprises first and second memory means for storing the identification code data of said first character set and said second character set, respectively, the identification code data being stored in said second memory means when the identification code corresponding to said second character set is received by said data receiving means.

12. The word processing device according to claim 11, wherein the identification code data stored in said second memory means is transferred to said first memory means when the succeeding character data is discriminated not to be one of said common character data by said discriminating means.

13. The word processing device according to claim 12, which further comprises print controlling means for controlling said device to print the data stored in said printing data storing means when data of one line is entered in said printing data storing means.

14. The word processing device according to claim 13, which further comprises print controlling means for controlling said device to pause for changing of a currently used printing element to another printing element carrying the character set identified by the identification code data read out of said printing data storing means when said identification code data is read out of said printing data storing means.

15. The word processing device according to claim 14, which further comprises representing means for representing the pausing condition when said identification code data is read out of said printing data storing means.

16. The word processing device according to claim 14, wherein said printing elements comprises daisy wheels which carry said character sets, respectively.

17. The word processing device according to claim 16, wherein said input means comprises a keyboard having a plurality of keys, said keyboard being used for inputting the character data of said plurality of character sets identified by said identification code data, the identification code data being inputted into said text data storing means prior to the succeeding character data when the character set used in inputting said succeeding character data is different from the character set used in inputting said preceding character set.

* * * * *